US009670428B2

(12) United States Patent
Schulze et al.

(10) Patent No.: US 9,670,428 B2
(45) Date of Patent: Jun. 6, 2017

(54) METHOD AND DEVICE FOR STARTING UP GASIFYING REACTORS OPERATED WITH COMBUSTIBLE DUST

(75) Inventors: Olaf Schulze, Tuttendorf (DE); Anton Althapp, Oberschöna (DE); Michael Gätke, Freiburg (DE); Burkhard Möller, Kleinwalersdorf (DE); Reinhold Grunwald, Hoyerswerda (DE); Wolfgang Rabe, Bernsdorf (DE); Günter Scholz, Hoyerswerda (DE)

(73) Assignee: SIEMENS AKTIENGESELLSCHAFT (DE)

( * ) Notice: Subject to any disclaimer, the term of this patent is extended or adjusted under 35 U.S.C. 154(b) by 1164 days.

(21) Appl. No.: 13/056,337

(22) PCT Filed: Jul. 15, 2009

(86) PCT No.: PCT/EP2009/005125

§ 371 (c)(1),
(2), (4) Date: Mar. 15, 2011

(87) PCT Pub. No.: WO2010/012376

PCT Pub. Date: Feb. 4, 2010

(65) Prior Publication Data

US 2011/0195365 A1 Aug. 11, 2011

(30) Foreign Application Priority Data

Aug. 1, 2008 (DE) ..... 10 2008 036 058

(51) Int. Cl.
*F23L 7/00* (2006.01)
*C10J 3/30* (2006.01)
(Continued)

(52) U.S. Cl.
CPC . *C10J 3/30* (2013.01); *C10J 3/50* (2013.01); *C10J 3/723* (2013.01); *C10J 3/726* (2013.01);
(Continued)

(58) Field of Classification Search
CPC ..... C10J 3/726; C10J 3/30
(Continued)

(56) References Cited

U.S. PATENT DOCUMENTS 4,457,695 A * 7/1984 Kummel ..... 431/168
4,482,275 A * 11/1984 Shinozaki et al. ..... 406/12
(Continued)

FOREIGN PATENT DOCUMENTS

CN 1032746 5/1989
CN 1945121 4/2007
(Continued)

OTHER PUBLICATIONS

International Search Report, PCT/EP2009/005125, Apr. 16, 2010, 3 pgs.
(Continued)

*Primary Examiner* — Avinash Savani
*Assistant Examiner* — Aaron Heyamoto
(74) *Attorney, Agent, or Firm* — Ostrolenk Faber LLP

(57) ABSTRACT

The invention relates to a method for starting up a gasifying reactor comprising a plurality of burners. Each burner is thereby charged with combustible dust from a metering vessel (1) via a dense flow conveyor line (51, 52, 53, 54), which is assigned thereto, and with fuel gas via a gas conveyor line (62, 63), wherein a fuel mixture of combustible dust and combustible gas is provided prior to a moment of ignition of a burner, wherein a first composition of combustible dust and combustible gas, with which a first burner is charged for ignition, is regulated as a function of the fuel quantity, which was supplied to the second burner for ignition, after the ignition of a second burner, which is charged with a second composition of combustible dust and combustible gas for ignition, following the ignition of the first burner, so that the starting up of each of the plurality of
(Continued)

burners of the gasifying reactor takes place under a regulated supply of the fuel load. The invention further relates to a gasifying reactor (7) for carrying out the method according to the invention.

21 Claims, 2 Drawing Sheets

(51) Int. Cl.
*C10J 3/72* (2006.01)
*C10J 3/50* (2006.01)

(52) U.S. Cl.
CPC .. *C10J 2200/152* (2013.01); *C10J 2300/0933* (2013.01); *C10J 2300/1223* (2013.01)

(58) Field of Classification Search
USPC ..... 431/2, 6
See application file for complete search history.

(56) References Cited

U.S. PATENT DOCUMENTS

| | | | | |
|---|---|---|---|---|
| 4,830,545 | A | 5/1989 | Salter et al. | 406/12 |
| 4,936,870 | A | 6/1990 | Baumann et al. | |
| 5,941,697 | A * | 8/1999 | Chaouki et al. | 431/7 |
| 7,607,398 | B2 | 10/2009 | Tietze et al. | |
| 7,762,200 | B2 | 7/2010 | Fischer et al. | 110/347 |
| 2007/0074643 | A1 | 4/2007 | Tietze et al. | 110/101 |
| 2007/0079554 | A1 | 4/2007 | Schingnitz et al. | |
| 2008/0000404 | A1 * | 1/2008 | Fischer et al. | 110/347 |
| 2008/0047196 | A1 | 2/2008 | Schingnitz | |

FOREIGN PATENT DOCUMENTS

| | | | |
|---|---|---|---|
| CN | 101096605 | | 1/2008 |
| DE | 33 12 449 | A1 | 12/1983 |
| DE | 223 613 | A3 | 6/1985 |
| DE | 38 23 773 | A1 | 1/1990 |
| DE | 10 2005 047 583 | A1 | 4/2007 |
| DE | 10 2005 048 488 | A1 | 5/2007 |
| DE | 10 2006 030 079 | A1 | 1/2008 |
| EP | 0 014 769 | A1 | 9/1980 |
| EP | 0014769 | | 9/1980 |
| EP | 0 308 026 | A2 | 3/1989 |

OTHER PUBLICATIONS

English translation of International Preliminary Report on Patentability, International Application No. PCT/EP2009/005125, Apr. 28, 2011, 13 pgs.

English translation of a Chinese Office Action and Search Report issued in Chinese Application No. 200980129271.4 dated Jul. 7, 2014.

Patent Examination Report No. 1 dated Aug. 7, 2015 in corresponding Australian Patent Application No. 2009275490 (5 pages).

* cited by examiner

METHOD AND DEVICE FOR STARTING UP GASIFYING REACTORS OPERATED WITH COMBUSTIBLE DUST

CROSS-REFERENCE TO RELATED PATENT APPLICATIONS

This application is a National Stage of International Application No. PCT/EP2009/005125, filed Jul. 15, 2009, which is based upon and claims the benefit of priority from prior German Patent Application No. 10 2008 036 058.9, filed Aug. 1, 2008, the entire contents of all of which are incorporated herein by reference in their entirety.

The invention relates to a method and a device for starting up gasifying reactors, which are operated with combustible dust.

STATE OF THE ART

Gasifying reactors with a high rating, in particular with more than 200 MW, are equipped with a plurality of burners for supplying gasifying agents and fuel in a known manner, independent on whether gas, solid matter or liquid fuel is used. Load changes are hereby mainly made by means of switching the individual burners arranged on the head of the gasifying reactor on and off and, to a limited extent, by means of a changed fuel supply by means of variable differential pressure adjustments between gasifying reactor and metering vessel for the dust supply.

The dust discharge speed on the burner cannot fall below a minimum of 3 to 5 m/s, so as to avoid flashbacks. In response to the starting up of gasifying reactors with high efficiency, considerable gas quantities are thus released in response to the ignition, which cannot be utilized all at once in the downstream process stages and which must thus be burnt off into the atmosphere.

DE 33 124 49 A1 and DD 22 36 13 A3 describe methods and devices for improving the regulating behavior of gasifying reactors, which pursue the goal of reaching a more even characteristic of the mass flow by means of vibratory movements of the support gas flow for the dense flow conveyance of the combustible dust, mainly in the lower load range. A proportional control gas flow comprising a pulse frequency of from 0.5 to 10 $s^{-1}$ is to thereby be supplied to the main dense flow. This solution requires a high technical effort and obtains advantages for the regulating behavior of gasifying reactors only to a limited extent.

DE 10 2005 048 488 A1 describes a method and a device for fuel gasifiers with high efficiency, wherein combustible dust comprising a water content of less than 10 mass percent and a grain size of below 200 μm is applied via metering systems. These supply the combustible dust via conveying pipes to a plurality of gasifying burners, which are arranged symmetrically on the head of the gasifying reactor and which contain additional oxygen supplies. The ignition of a plurality of dust burners by means of oxygen thus takes place in the head of the reactor by means of ignition and pilot burners. A quantitative detection of the supplied combustible dust and oxygen thereby takes place in combination with a determined oxygen ratio and a regulating mechanism. The large gas quantities, which are also generated with this method in response to the starting up must be burned in the atmosphere via burning systems, so as to avoid load fluctuations.

DE 102005047 583 A1 describes a method and a device for the regulated supply of combustible dust into a fuel gasifier. The method mainly differs from current known solutions in that an auxiliary gas is supplied into the metering line in the direct vicinity of the metering vessel for the combustible dust and the dust mass flow is also controlled in the case of low efficiency via the resulting differential pressure changes between metering vessel and burner. Due to the quite different flow behavior of many combustible dusts, this method is also suitable for controlling the load of gasifying reactors with a high efficiency only to a limited extent.

A device, which provides for a starting up of a gasifying reactor for combustible dusts such that pressure surges are not generated by the gas quantity, which is released abruptly in response to starting up, is not known so far from the state of the art.

DISCLOSURE

Based on this state of the art, the instant invention is based on the object of providing a method and a device for starting up a gasifying reactor, which avoids the pressure surges in the process stages downstream from the gasifying reactor, which are caused by the gas quantity released abruptly in response to the starting up and which does not require a burn-off. This object is solved by means of a method comprising the features of the independent claim 1 and by means of a device comprising the features of the independent claim 12. Further developments are described in the subclaims.

One embodiment relates to a method for starting up a gasifying reactor. A first composition of combustible dust and combustible gas with which a first burner is charged and ignited is thereby regulated as a function of the fuel quantity in the next composition of combustible dust and combustible gas, which is supplied to the second burner for ignition after the first burner was ignited.

In another embodiment, this method step can also be carried out analogously by means of further burners, so that a fuel composition of a previously ignited burner is regulated after the ignition of a further burner as a function of the fuel quantity, which was supplied to the burner, which was ignited subsequently. The starting up of the gasifying reactor thus takes place under a regulated supply of the fuel load.

As a result of the regulatability, the method according to the invention offers the advantage that the creation of pressure surges caused by released gas, which could otherwise not be used and which would have to be burned off, and which is thus disadvantageous for downstream process stages, is avoided. In addition, it is possible to secure a considerably more even dust flow out of the metering vessel for the respective burner by avoiding pressure fluctuations in the gasifying reactor, because the pressure difference between gasifying reactor and metering vessel causes the conveyance of the combustible dust into the gasifying reactor.

One embodiment of the device for carrying out the method according to the invention describes a gasifying reactor comprising a plurality of burners and a metering vessel for combustible dust, which is connected to a corresponding burner via a plurality of dense flow conveyor lines. A dust flow regulating element for regulating a combustible dust quantity is thereby preferably arranged in each dense flow conveyor line. For the purpose of regulating a combustible gas quantity, the device thus furthermore encompasses at least one admixing device for a combustible gas to each dense flow conveyor line.

Preferred embodiments relate to the arrangement of the admixing devices for combustible gas as well as to the operative coupling of the dust flow regulating elements with the admixing devices for regulating the fuel compositions with reference to an overall fuel load of combustible dust and combustible gas.

Considerable advantages of the invention as compared to the state of the art result from the method according to the invention in particular by the possibility for regulating the composition of the fuel quantity supplied to the gasifying reactor in the form of combustible dust and combustible gas in response to the starting up of reactors, which provide outputs of from 200 MW up to 1500 MW and which are equipped with a plurality of main burners, so that the gas quantity generated in response to the starting up of the gasifying reactor is not abruptly released in a pressure surge, but increases gradually by the sequential ignition of the burners and the adaption of the fuel compositions. Disadvantageous effects on the downstream process stages are avoided by avoiding pressure surges, which are generated by the gas quantities, which are released suddenly in response to the starting up of such large gasifying reactors, and a more even dust flow rate is at the same time supplied from the metering vessels into the respective burners in an advantageous manner. A burn-off of large gas quantities, which are released suddenly in the start phase, as is necessary in the case of devices from the state of the art, is thus not necessary.

These and further advantages are explained by means of the following description with reference to the accompanying figures.

BRIEF DESCRIPTION OF THE FIGURES

The reference to the figures in the description serves to support the description. The figures are only schematic illustrations of embodiments of the invention.

DESCRIPTION

Figure 1:
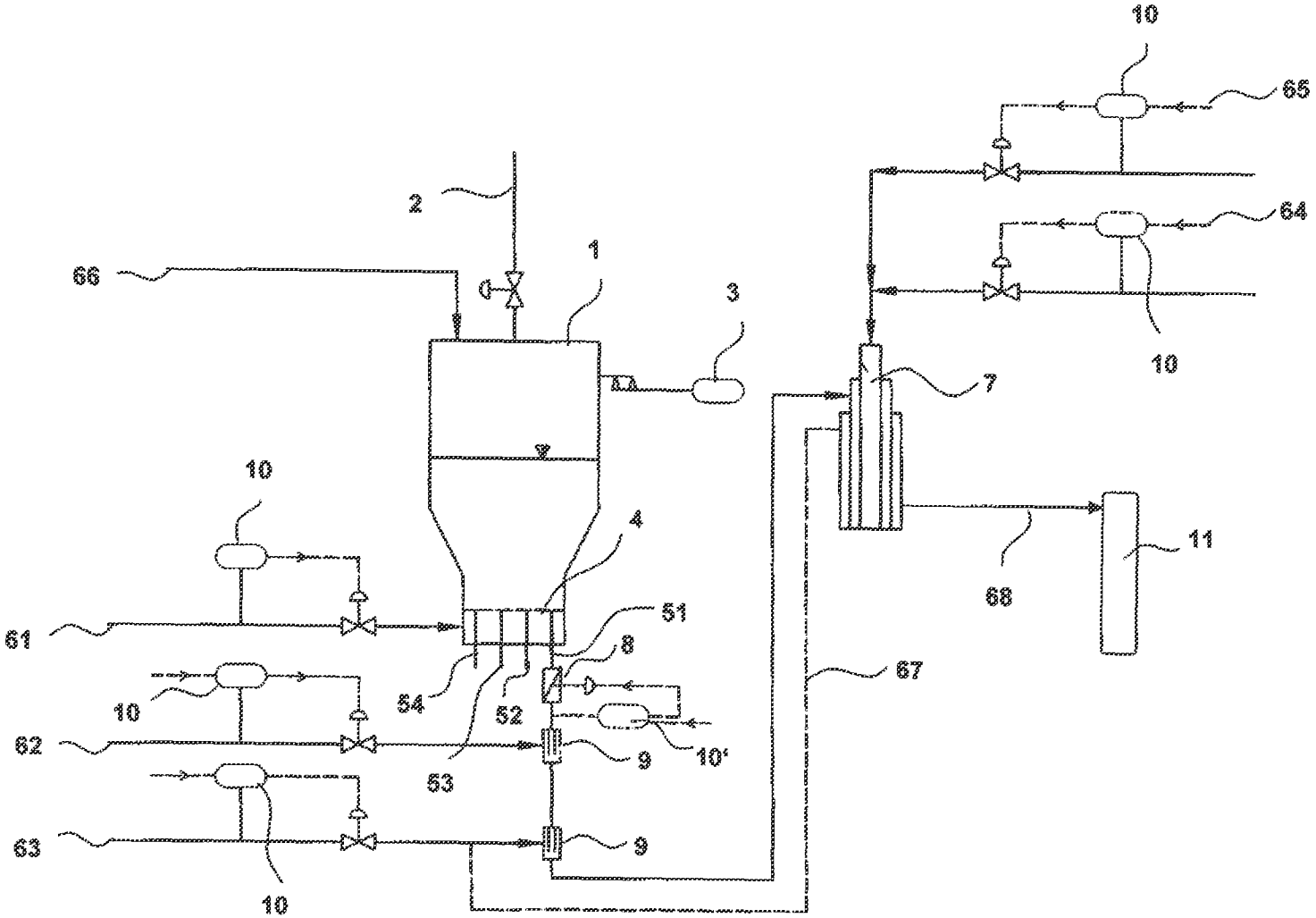
FIG. 1 shows a schematic illustration of a device according to the invention.

To clarify the meaning, as it is to be understood in the instant invention, several terms will be defined below as follows.

"Starting up" the gasifying reactor refers to the startup procedure thereof by igniting the burners. In the event that all burners of the gasifying reactor burn, the starting up has ended and the gasifying reactor operates in normal operation.

The term "fuel load" refers to the mass flow or flow rate of fuel, whether it is gas, liquid and/or solid matter fuel, which is converted by a gasifying reactor. A burner of a gasifying reactor must be operated with a "minimum discharge speed" at the burner tip in response to the ignition, which lies in the range of from 3 to 5 m/s so as to prevent flashbacks.

"Synthesis gas" consisting of carbon monoxide and hydrogen is won from the used fuel in a gasifying reactor and the generated synthesis gas is further processed in downstream process stages, for example in the methanol, oxo or Fischer-Tropsch synthesis. The generated hydrogen is also used separately, in the ammonia synthesis according to Haber-Bosch with nitrogen as energy source or reduction or hydrogenation agent.

The method according to the invention for starting up gasifying reactors, which have two or more burners, each of which is charged with combustible dust from a metering vessel via a dense flow conveyor line assigned to said burner and with combustible gas via a gas conveyor line, comprises the provision of a fuel mixture consisting of combustible dust and combustible gas prior to a moment of ignition of a burner. The combustible gas used for this purpose is not an auxiliary gas in terms of a gas used for the pressure compensation between metering vessel and gasifying reactor, which is an inert gas in many cases, but a combustible gas comprising a calorific value. A natural gas, preferably comprising a methane content of more than 60%, can be used as combustible gas. Further alkanes, such as ethane, propane and butane and mixtures thereof can be used. Suitable combustible gases are known to the person of skill in the art.

According to the invention, a first composition of combustible dust and combustible gas with which a first burner is charged for ignition after the ignition of a second burner, which follows the ignition of the first burner and which is charged with a second composition of combustible dust and combustible gas for ignition, is regulated as a function of the fuel quantity, which was supplied to the second burner for ignition, so that the starting up of each of the plurality of burners of the gasifying reactor takes place under a regulated supply of the fuel load. The combustible gas content in the mixture of combustible gas and combustible dust can furthermore be varied or the mixture composition can be adjusted so as to be regulated, respectively, so as to reduce the combustible dust load, if necessary.

When the gasifying reactor has more than two burners, a second or a third or a further composition, which is supplied to a further burner, is regulated as a function of the fuel quantity, which was supplied to the corresponding previous burner for ignition, after a third or further burner, which is charged with a third or further composition of combustible dust and combustible gas for ignition, was ignited following the ignition of the second burner according to the method according to the invention.

The individual burners are thereby ignited in a lower load range, that is, the minimally possible fuel load for the individual burner is from 1% to 30% of the maximum load of the individual burner, which is defined by the maximum fuel load in response to a maximum discharge speed. Through this, the smallest possible quantity of synthesis gas, which can be generated, is thus released in response to the ignition of the first burner of the gasifying reactor, and in that the fuel load, which is supplied to the previously ignited burner in response to the ignition of the second or third burner or of the further burners, respectively, is cut back by regulating the fuel composition, which is compensated for by igniting the fuel load added to the downstream burner and which causes a gradual increase of the generated quantity of synthesis gas and thus a gradual pressure increase as compared to the very small steps in the state of the art virtually "continuously" causes the generated synthesis gas to be capable of being supplied to the downstream process stages as early as in the starting up phase of the gasifying reactor.

The quantity of synthesis gas generated in the gasifying reactor is correlated directly with the supplied fuel load. The minimum load of fuel required for starting up the gasifying reactor thus determines the generated quantity of synthesis gas, which is released in response to the starting up of the gasifying reactor.

The combustible gas is in each case supplied into the corresponding dense flow conveyor line, which is assigned to the burner, via at least one admixing device between the metering vessel and the respective burner of the gasifying reactor.

In the alternative, the combustible gas can also in each case be guided into the admixing device parallel to the dense flow conveyor line via a combustible gas conveyor line and can be guided from there into the burner as a mixture, wherein the advantage of the parallel guide lies in a regulating unit, which can be used together by the dense flow conveyor line and the combustible gas conveyor line, because the lines are located directly adjacent to one another.

In the method according to the invention, the combustible dust load in the dense flow conveyor line is regulated by means of a dust flow regulating device, which can be a throttle, a baffle or a valve, for example, and which is in operative connection with the admixing devices for the combustible gas. The combustible dust quantity and combustible gas flows for a burner can thus be adjusted by means of a control and regulating unit as a function of one another and as a function of the combustible dust mass flows and combustible gas flows of the previously ignited burners. The regulation can be connected directly to the ignition point of the individual burners. Advantageously, corresponding measuring devices can be provided for determining the gas quantities generated in the gasifier and/or the compositions thereof downstream to the gasifying reactor upstream of the downstream process stages and the determined measuring values can be output to the control and regulating unit. This unit compares the measuring values with corresponding setpoint values and adapts the combustible dust flow rate and combustible gas flows for the burners in the event of non-conformance. The person of skill in the art knows that a manual adjustment of the combustible dust flow rate and combustible gas flows is also possible.

In so doing, the generated synthesis gas quantity can be increased gradually in response to the starting up of the gasifying reactor after the ignition of the first burner and of the further burners in optimally minimized stages in that the fuel mixture of the previously ignited burners is adapted after the igniting of further burners with reference to mass flow and/or composition by means of the regulation/control of the combustible dust flow rate and combustible gas flows for the burners.

The method according to the invention for starting up is in particular suited for large gasifying reactors. The term "large gasifying reactor" relates to gasifiers with an output of above 200 MW, for example a 400 MW gasifying reactor. Gasifiers with 500 MW are also used technically. Theoretically, the method according to the invention can also be used for gasifying reactors with outputs of 1,000 MW and 1,500 MW.

A lower load range of such a large gasifying reactor with 400 MW, for example, is thus 40 t/h fuel load in the case of the minimum discharge speed, which is 3 m/s. This corresponds to approximately 60% of the maximum fuel load, which this gasifying reactor can put through, namely 65 t/h, which can be obtained with a maximum discharge speed of 8 m/s.

In the event that the reactor according to the state of the art is started up with 60% of the maximum load, thus in response to a 40 t/h fuel load, this means an immediately released synthesis gas quantity of 60,000 $Nm^3/h$. With the method for starting up according to the invention, however, in the case of which an individual burner is charged in its lower load range up to 30% of the maximum load for the individual burner, a maximum of only 20,000 $Nm^3/h$ of synthesis gas are released in response to the ignition of the first burner by means of the 400 MW gasifying reactor, which is equipped with 3 individual burners, for example. The synthesis gas quantity is then increased successively to 40,000 $Nm^3/h$ with the ignition of the second burner, which analogously releases 20,000 $Nm^3/h$ of synthesis gas, and accordingly to 60,000 $Nm^3/h$ with the ignition of the third burner, when each individual burner is operated with a minimum load, which then corresponds to the minimum load of the gasifying reactor of 60,000 $Nm^3/h$. By changing the composition of the fuel load, the total output can be increased up to the nominal output. According to the mentioned example of a 400 MW gasifying reactor comprising 3 burners, the gradual increase of the synthesis gas quantity can still be reduced in that four or more burners are used, so that the synthesis gas quantity released for each burner corresponds to a fourth or to a fraction of the minimum load of the gasifying reactor. A "quasi continuous" starting up of the gasifying reactor can be nearly reached therewith.

In an embodiment of the method according to the invention, the combustible dust quantity for the compositions is regulated as a function of the supplied combustible gas quantity, that is, the combustible dust flow rate is adjusted as a function of the supplied combustible gas quantity, that is, with the help of the dust flow regulating device. Alternatively, the reverse approach is also possible, in that the combustible gas supply is increased or throttled as a function of the supplied combustible dust flow rates. A flow speed of the combustible dust can thereby lie in the range of from 3 to 5 m/s.

The combustible dusts can thereby comprise dusts of solid fuels, such as coal, lignite, the cokes thereof, petroleum cokes as well as cokes of peat or biomass or the mixtures thereof; further suitable types of combustible dust are known to the person of skill in the art.

The device for carrying out the method according to the invention comprises a gasifying reactor comprising a plurality of burners as well as a metering vessel comprising a combustible dust supply and a plurality of dense flow conveyor lines. A dense flow conveyor line thereby leads to a corresponding burner of the gasifying reactor in each case. A dust flow regulating device for regulating a combustible dust flow and at least one admixing device for a combustible gas for regulating a combustible gas quantity are arranged in each dense flow conveyor line.

The device can thereby encompass an admixing device for combustible gas between the metering vessel and the respective burner in the corresponding dense flow conveyor line, wherein the dust flow regulating device comprises a flow regulator for measuring the combustible dust flow. In the alternative, the admixing device for combustible gas can also be arranged directly on a supply opening of the burner and the combustible gas conveyor line can advantageously run parallel to the dense flow conveyor line, whereby the regulation of the combustible dust flow is simplified by means of the dust flow regulating device, which can then simply be a baffle or a throttle and which does not require an additional flow regulator.

The dust flow regulating device in each dense flow conveyor line and the admixing devices for combustible gas are coupled to one another operatively, so that a regulation of a total fuel load of combustible dust and combustible gas takes place into the gasifying reactor.

FIG. 1 shows a diagram of the device according to the invention. In this diagram, a combustible dust supply 2 discharges into the metering vessel 1. Dense flow conveyor lines 51 to 54 extend from the inflow bases 4 of the metering vessel 1 to the burners (not shown individually) of a multi channel burner 7. A gas conveyor line 61 to the inflow base 4 serves to introduce a fluidizing gas. The gas conveyor lines 62 and 63 in each case discharge into the dense flow conveyor line 51 via an admixing device 9. The dense flow conveyor systems 51 to 54 are in each case designed analogously, but for reasons of clarity, only the dense flow conveyor line 51 is illustrated completely with admixing devices 9 and dust flow regulating device 8 in FIG. 1. The further dense flow conveyor lines encompass dust flow regulating member and admixing devices according to the dense flow conveyor line 51. The dust regulation device 8 is connected to an additional flow regulator 10', which is coupled back into the dense flow conveyor line 51. The additional flow regulator 10 for the dust regulation device 8 is not necessary (the dotted arrows suggest this) when the gas conveyor line 63 discharges into the combustible gas conveyor line 67, which runs parallel to the dense flow conveyor lines 51 and which is illustrated with a dotted line. Said combustible gas conveyor line 67 leads to a supply opening of the burner, which belongs to the dense flow conveyor lines 51.

The detection of the dust quantities, which are supplied and discharged, from the metering vessel 1 takes place via a scaling system 3. The detection and regulation of the gas quantities in the gas conveyor lines 62, 63 as well as in the fluidizing gas line 61, oxygen line 64 and water vapor line 65 takes place via the flow regulators 10. The regulation of the combustible dust mass flow in the dense flow conveyor line 51 to 54 takes place in each case via a dust flow regulating element 8. The admixing of combustible gas into the respective dense flow conveyor line 51 to 54 from the conveyor line 62 or 63 takes place via at least one of the admixing devices 9. An admixing of inert gas can furthermore take place via a conveyor line 62 or 63 by means of admixing device 9. A mixture of combustible and inert gas in a conveyor line is also possible. The supply of combustible gas can furthermore also take place via the fluidizing gas line 61 to the inflow base, whereby the combustible dust in the metering vessel 1 is moved into the flow state. Alternatively, an inert gas is used as fluidizing gas. A synthesis gas conveyor line 88 leads from the multi-channel burner 7 into a downstream process stage 11.

The gradual increase of the generated synthesis gas quantity in response to starting up of a gasifying reactor (not illustrated), which is equipped with 4 burners, for example, in optimally minimized stages through the regulation/control of the combustible dust and combustible gas load takes place such that the combustible dust load increase connected to the switch-on of the second, third and fourth burner, takes place in combination with the change of the first, second and third compositions of the fuel mixtures of the burners, which were started up previously. Either the combustible dust quantity or the combustible gas quantity fed into the dense flow conveyor line can hereby be used for the regulation.

Figure 2:
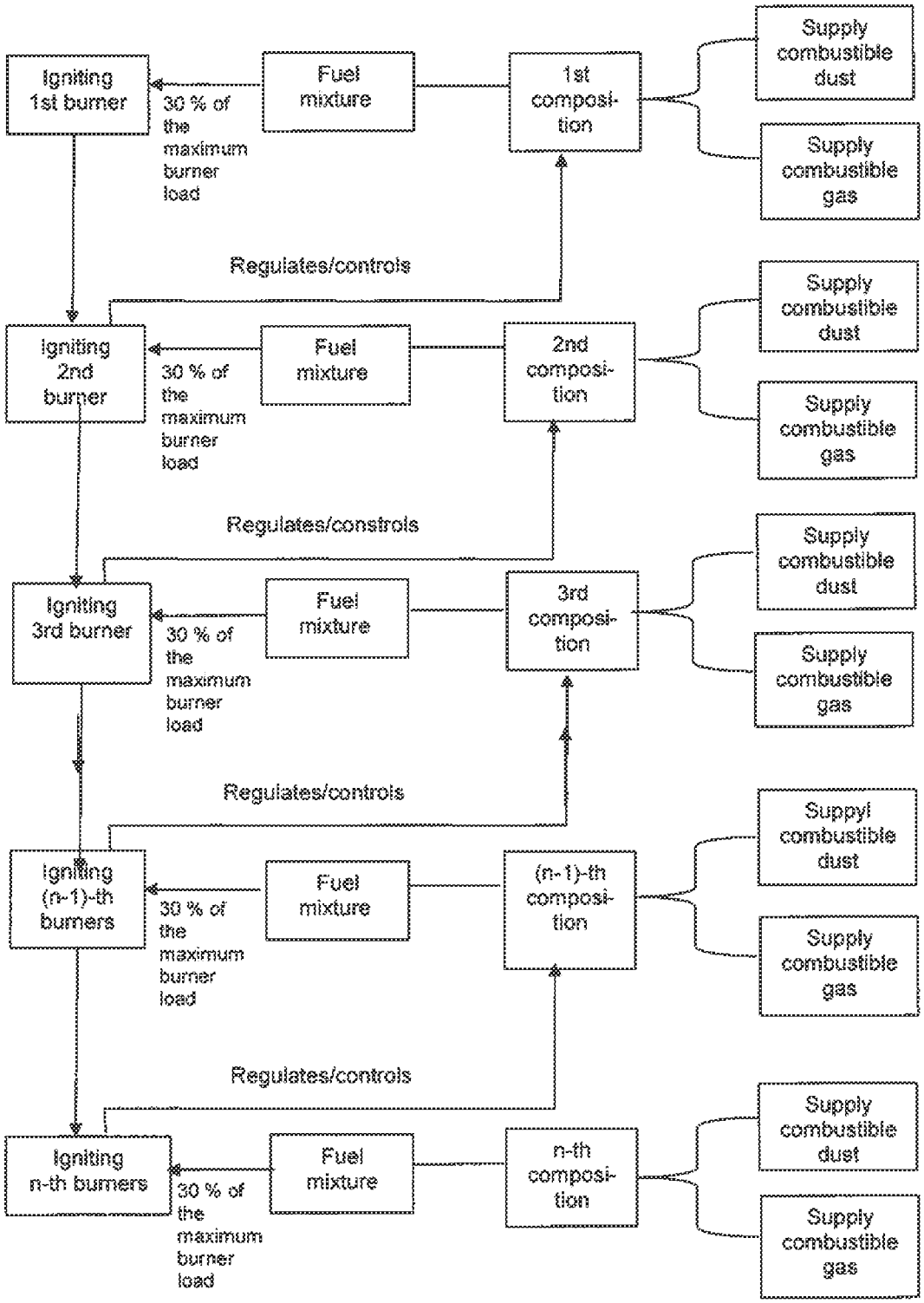
FIG. 2 shows a flow chart of the method according to the invention.

The method according to the invention is clarified by means of the schematic illustration in FIG. 2. A fuel mixture comprising a first composition of combustible dust and combustible gas, which is ignited on a first burner of a gasifying reactor comprising a plurality of burners in a lower load range of the burner of up to 30% of the maximum burner load, is thereby provided initially. After the ignition of the first burner, the ignition of a second burner takes place in its lower load range, which is charged with a second composition of the fuel mixture of combustible dust and fuel. The ignition of the second burner thereby automatically triggers the regulation/control for changing the first composition of the fuel mixture, so that the fuel load added by the ignition of the second burner is caught by changing the first composition. For example, the combustible gas portion in the first composition can be reduced, so that the load increase from first ignition to second ignition can be adapted.

The ignition of a third or further "n-th" burner takes place analogously. A change of the second composition of the fuel mixture of the previously ignited second burner is regulated/controlled by igniting the third burner in its lower load range, which is in turn charged with a third composition of the fuel mixture of combustible dust and gas. The ignition of an "n-th" burner in the lower load range thereof, which is charged with an "n-th" composition of the fuel mixture of combustible dust and combustible gas, will thus also cause the (n−1)-th composition of previously ignited (n−1)-th burners is to be changed in a regulated manner.

LIST OF REFERENCE NUMERALS

| | |
|---|---|
| 1 | Metering vessel |
| 2 | Combustible dust supply |
| 3 | Scaling system |
| 4 | Inflow base |
| 51 | Dense flow conveyor line 1 |
| 52 | Dense flow conveyor line 2 |
| 53 | Dense flow conveyor line 3 |
| 54 | Dense flow conveyor line 4 |
| 61 | Fluidizing gas line |
| 62 | Gas conveyor line 1 (combustible gas, inert gas) |
| 63 | Gas conveyor line 2 (combustible gas, inert gas) |
| 64 | Oxygen line |
| 65 | Water vapor line |
| 66 | Pressure load gas line |
| 67 | Combustible gas conveyor line |
| 68 | Synthesis gas conveyor line |
| 7 | Multi-channel burner |
| 8 | Dust flow regulating device |
| 9 | Admixing device |
| 10 | Flow regulator |
| 10' | Flow regulator of the dust flow regulating device |
| 11 | Downstream process stage |

The invention claimed is:

1. A method for starting up a gasifying reactor that includes a plurality of burners, wherein each burner is charged with combustible dust from a metering vessel via a dense flow conveyor line, which is assigned thereto, and with combustible gas via a gas conveyor line, wherein a fuel mixture of combustible dust and combustible gas is provided prior to a moment of ignition of a burner, the method comprising:

charging a first one of the burners with a first fuel load having a first composition, the first composition being based on a combustible dust flow and a combustible gas flow to ignite the first burner;

charging a second one of the burners with a second fuel load having a second composition, the second composition being based on a combustible dust flow and a combustible gas flow to ignite the second burner after igniting the first one of the burners; and decreasing the fuel load to the first burner in response to igniting of the second burner to generate synthesis gas gradually by modifying the first composition to obtain a modified first composition, the modified first composition including a combustible dust flow and a combustible gas flow and being modified based on the second fuel load supplied to the second burner for ignition and in response to the ignition of the second burner, the modified first composition being different than the first composition, wherein the combustible gas flow in the first composition is reduced when the second burner is ignited.

2. The method according to claim 1, further comprising supplying a third fuel load having a third composition of combustible dust and combustible gas to a third burner in the plurality of burners; igniting the third fuel load; modifying the second composition in response to igniting of the third composition.

3. The method according to claim 1, wherein the combustible gas is supplied into the corresponding dense flow conveyor line via at least one admixing device located between the metering vessel and the respective burner.

4. The method according to claim 1, wherein the combustible gas is supplied directly to a supply opening of the burner via at least one admixing device parallel to the dense flow conveyor line via a combustible gas conveyor line.

5. The method according to claim 1, wherein a combustible dust flow regulating device, which regulates the combustible dust load in the dense flow conveyor line, is in operative connection with the admixing devices for the combustible gas.

6. The method according to claim 1, wherein all of the individual burners of the plurality of burners are ignited successively, and wherein the fuel load for each burner is no more than 40% of its maximum load.

7. The method according to claim 6, wherein during the starting up of the individual burners a combustible dust load is adjusted up to 40% of the maximum load of each burner.

8. The method according to claim 6, wherein the fuel load for each burner is no more than 30% of its maximum load.

9. The method according to claim 1, wherein the gasifying reactor is charged with combustible dust from of a solid fuel.

10. The method according to claim 9, wherein the solid fuel is selected from a group consisting of coal ignite, coke and coke of biomass.

11. The method according to claim 1, wherein the gasifying reactor yields an output in a range of from 200 MW to 1500 MW.

12. The method according to claim 1, wherein a flow speed of the combustible dust lies in the range of from 2 to 4 m/s.

13. A gasifying reactor device comprising a plurality of burners; at least one metering vessel; and a plurality of dense flow conveyor lines for supplying combustible dust, each dense flow conveyor line supplying combustible dust to a respective one of the burners, a combustible dust flow regulating device for regulating a combustible dust flow rate arranged in or on each dense flow conveyor line in operative connection with the dense flow conveyor line of each respective burner;

at least one admixing device for a combustible gas arranged upstream of each burner or on the burner on each dense flow conveyor line; and a control and regulating unit to adjust supply of fuel load to each burner, each fuel load having a composition based on a combustible dust flow and a combustible gas flow;

wherein the combustible dust regulating devices and the admixing devices are in operative connection with one another, and wherein the control and regulating unit decreases the supply of fuel load by modifying the composition to each burner based on fuel load supplied to a burner located downstream and in response to ignition of the burner located downstream, wherein the modified composition for each burner includes a combustible dust flow and a combustible gas flow, and for each burner the combustible gas flow of the modified composition is reduced relative to the combustible gas flow of the composition for the burner.

14. The device according to claim 13, wherein the admixing device for combustible gas is arranged in the corresponding dense flow conveyor line or on a supply opening of the burner.

15. The device according to claim 13, wherein a combustible gas conveyor line for supplying combustible gas into the admixing device is arranged separated from and close to, in particular parallel to the dense flow conveyor line.

16. The device according to claim 13, wherein the dust flow regulating device, which is arranged in each dense flow conveyor line and the admixing device for combustible gas, which is assigned to each burner, are operatively connected to one another, wherein the operative coupling forms a regulation of the total fuel load of combustible dust and combustible gas supplied to the burners into the gasifying reactor in response to the ignition of further burners.

17. The method according to claim 1, wherein the gasifying reactor yields an output in a range of 200 MW to 500 MW.

18. The method according to claim 1, wherein the combustible gas comprises natural gas with a methane content of more than 50% by volume.

19. The method according to claim 1, wherein the combustible gas comprises natural gas with a methane content of more than 60% volume.

20. A method for starting up a gasifying reactor that includes a plurality of burners, wherein each burner is charged with combustible dust from a metering vessel via a dense flow conveyor line, which is assigned thereto, and with combustible gas via a gas conveyor line, wherein a fuel mixture of combustible dust and combustible gas is provided prior to a moment of ignition of a burner, the method comprising:

charging a first one of the burners with a first fuel load having a first composition, the first composition being based on a combustible dust flow and a combustible gas flow to ignite the first burner, the first fuel load being no more than 40% of maximum load of the first burner;

charging a second one of the burners with a second fuel load having a second composition, the second composition including a combustible dust flow and a combustible gas flow to ignite the second burner after igniting the first one of the burners, the second fuel load being no more than 40% of maximum load of the second burner; and decreasing the fuel load to the first burner in response to igniting of the second burner to generate synthesis gas gradually by modifying the first composition to obtain a modified first composition, the modified first composition being based on a combustible dust flow and a combustible gas flow and being modified based on the second fuel load supplied to the second burner for ignition and in response to the ignition of the second burner;

wherein the first composition is modified by throttling the fuel load supplied to the first burner, and wherein the combustible gas flow in the first composition is reduced when the second burner is ignited.

21. The method according to claim 20, wherein the first fuel load is no more than 30% of the maximum load of the first burner and the second fuel load is no more than 30% of the maximum load of the second burner.

* * * * *